US005779512A

United States Patent [19]

Rupert

[11] Patent Number: 5,779,512

[45] Date of Patent: Jul. 14, 1998

[54] FLOTATION DEVICE

[76] Inventor: Roger J. Rupert, 26 W. Second St., Fulton, N.Y. 13069

[21] Appl. No.: 790,797

[22] Filed: Jan. 30, 1997

Related U.S. Application Data

[60] Provisional application No. 60/001,704 Feb. 15, 1996.

[51] Int. Cl.[6] ..... B63C 9/08

[52] U.S. Cl. ..... 441/123

[58] Field of Search ..... 441/122, 123, 441/129, 131, 81; 114/345, 346

[56] References Cited

U.S. PATENT DOCUMENTS

| | | | |
|---|---|---|---|
| 1,561,916 | 11/1925 | Ernst . | |
| 2,210,809 | 8/1940 | Gray | 441/123 |
| 2,742,654 | 4/1956 | Hurt | 441/123 |
| 3,048,860 | 8/1962 | Richardson | 441/123 |
| 4,021,873 | 5/1977 | Francois | 114/345 |
| 4,360,396 | 11/1982 | Marbach | 114/346 |
| 4,538,998 | 9/1985 | Holzel . | |
| 4,655,718 | 4/1987 | Lucius . | |
| 4,687,452 | 8/1987 | Hull | 441/131 |
| 4,820,221 | 4/1989 | Aubrey . | |
| 5,217,400 | 6/1993 | Creek et al. . | |
| 5,334,067 | 8/1994 | Henry et al. . | |

*Primary Examiner*—Ed L. Swinehart
*Attorney, Agent, or Firm*—Richard C. Litman

[57] ABSTRACT

A small bouyant tube is concentrically joined to a larger bouyant tube. The circle of joinder may be at any point from the inner circumference of the outer, larger tube up to the top of the outer tube. Thus, the inner, smaller tube may fit entirely within the outer tube, or be relatively larger in size and positioned upwardly from, but still partially within, the outer tube. The inner and outer tubes are preferably inflatable, wherein the inner tube may have an irregular contour for a more comfortable fit around the neck of the user floating in water. By comfortably and safely supporting the neck region above the surface of the water, the present invention inhibits movement of the spinal cord and reduces pressure thereto for relaxation and/or therapeutic purposes.

8 Claims, 5 Drawing Sheets

FLOTATION DEVICE

CROSS-REFERENCE TO RELATED APPLICATION

This application claims the benefit of U.S. Provisional patent application Ser. No. 60/011,704, filed Feb. 15, 1996.

BACKGROUND OF THE INVENTION

1. FIELD OF THE INVENTION

The present invention relates to flotation devices, and particularly to a pair of concentrically attached bouyant tubes.

2. DESCRIPTION OF THE PRIOR ART

It is often desirable to have limited movement of the spinal cord. Such is the case directly after a chiropractic adjustment where the patient should not stretch or be overly mobile. For purposes of maintaining the work performed by the chiropractor, the neck region should be especially inhibited from movement. Furthermore, if the patient is capable of relaxing the spinal cord by mitigating vertical compression thereon, the recently performed adjustments may be naturally maintained due to muscle memory. Floating in water may achieve this reduction in spinal cord pressure, in addition to helping the patient relax.

Numerous flotation devices have been invented in the prior art. Examples of these prior art devices include U.S. Pat. No. 1,561,916, issued on Nov. 17, 1925, to Gotthard Ernst, disclosing an inflatable swimming cushion. The cushion is designed to fit around a bather's waist rather than the neck, and while it has separately inflatable compartments, two concentrically attached tubes are not disclosed.

U.S. Pat. No. 4,538,998, issued on Sep. 3, 1985, to Bernd Hölzel, discloses a disk-shaped swimming and rescue device having an arm passage opening which includes an elastic, expandable edge. The disk is rendered buoyant by foam material.

U.S. Pat. No. 4,655,718, issued on Apr. 7, 1987, to John H. Lucius, discloses a personal flotation device with auxiliary pads, which is attached to the user by straps.

U.S. Pat. No. 4,820,221, issued on Apr. 11, 1989, to Martin G. Aubrey, discloses a buoyant garment to be worn on the upper body of the user, which includes rigid support members. Concentrically arranged bouyant tubes are neither shown nor suggested by Aubrey.

U.S. Pat. No. 5,217,400, issued on Jun. 8, 1993, to Wilson Creek and Peter L. Ross, discloses a U-shaped inflatable personal flotation device designed for fishermen.

U.S. Pat. No. 5,334,067, issued on Aug. 2, 1994, to David M. Henry and Ronald Marshall, discloses a fisherman's float ring. The float ring of Henry and Marshall shows two inflatable tubes, but only one tube at a time is inflated during use. The second tube is a backup in case the first tube leaks. There is a bottle of pressurized gas by which the second tube can be quickly inflated in an emergency.

None of the above inventions and patents, taken either singly or in combination, is seen to describe the instant invention as claimed. Thus a double inflatable tube solving the aforementioned problems is desired.

SUMMARY OF THE INVENTION

The present invention includes a small bouyant tube concentrically joined to a larger bouyant tube. The circle of joinder may be at any point from the inner circumference of the outer, larger tube up to the top of the outer tube. Thus, the smaller tube may fit entirely within the outer tube, or be relatively larger in size and positioned upwardly from, but still partially within, the outer tube. Furthermore, neither tube needs to be perfectly toroidal in shape. The inner tube, in particular, may have an irregular contour so as to fit the neck of a user even more comfortably.

The inner and outer tubes are preferably inflatable. In use, the user first inflates the outer, larger tube before inserting the neck region inside the inner tube. At this point, the user inflates the inner tube to a comfortable pressure. The invention may be used by anyone who simply wants to relax while in water. The user who is recovering from injuries to the neck, back or other areas will find the present invention especially beneficial for relaxation and/or therapeutic purposes. In particular, after work performed by a chiropractor, the present invention will minimize the movement of the spinal cord proximate the neck; reduce spinal cord pressure; and allow for naturally maintaining the recently performed adjustments. Furthermore, the device promotes safety; should the user relaxing in water fall asleep, the invention will hold the user's head above the water level.

Accordingly, it is a principal object of the invention to provide a therapeutic flotation device.

It is another object of the invention to provide a means for relaxing.

It is a further object of the invention to provide a device that may be safely and comfortably worn around the neck of a user while floating in water.

Still another object of the invention is to inhibit spinal cord movement proximate the neck region, particularly after a chiropractic adjustment.

It is another object of the invention is to reduce spinal cord pressure, particularly after a chiropractic adjustment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

As seen in FIGS. 1–5, the present invention 10 includes a small bouyant tube 12 concentrically and tangentially joined to a larger bouyant tube 14. The circle of joinder or region of attachment 20 may be at any point from the inner circumference of the outer, larger tube 14 up to the top of the outer, larger tube 14. Thus, the inner, smaller tube 12 may fit entirely within the larger tube 14, or be larger in size and positioned upwardly from, but still partially within, the larger tube 14. Furthermore, neither tube 12, 14 needs to be perfectly toroidal in shape. The inner, smaller tube 12, in particular, may have an irregular contour so as to fit the neck of a user even more comfortably.

Figure 1:
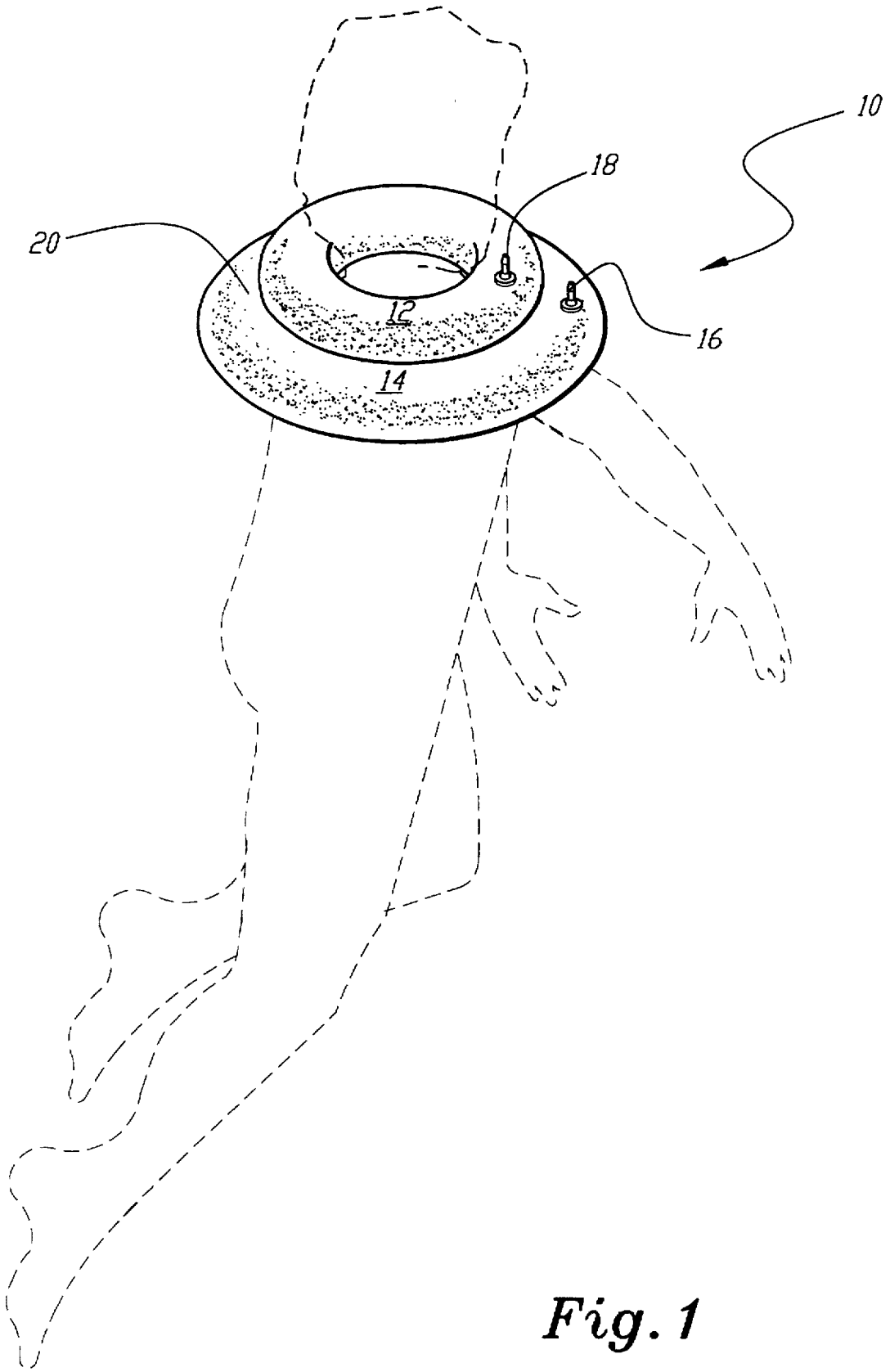
FIG. 1 is an environmental view of one embodiment of the invention, showing its use by a bather in a body of water.
Figure 2:
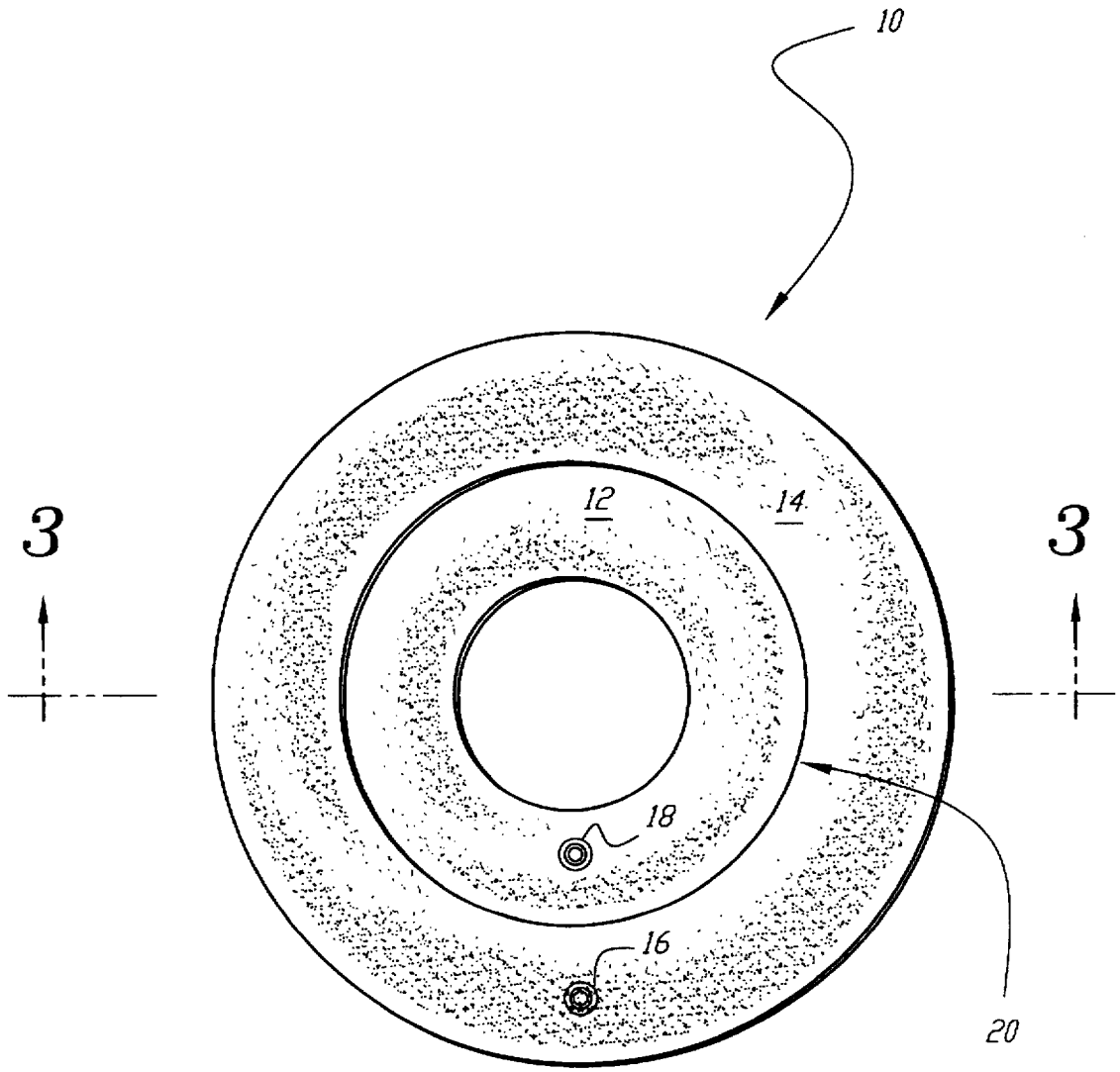
FIG. 2 is a top view of the embodiment of the invention as shown in FIG. 1.
Figure 3:
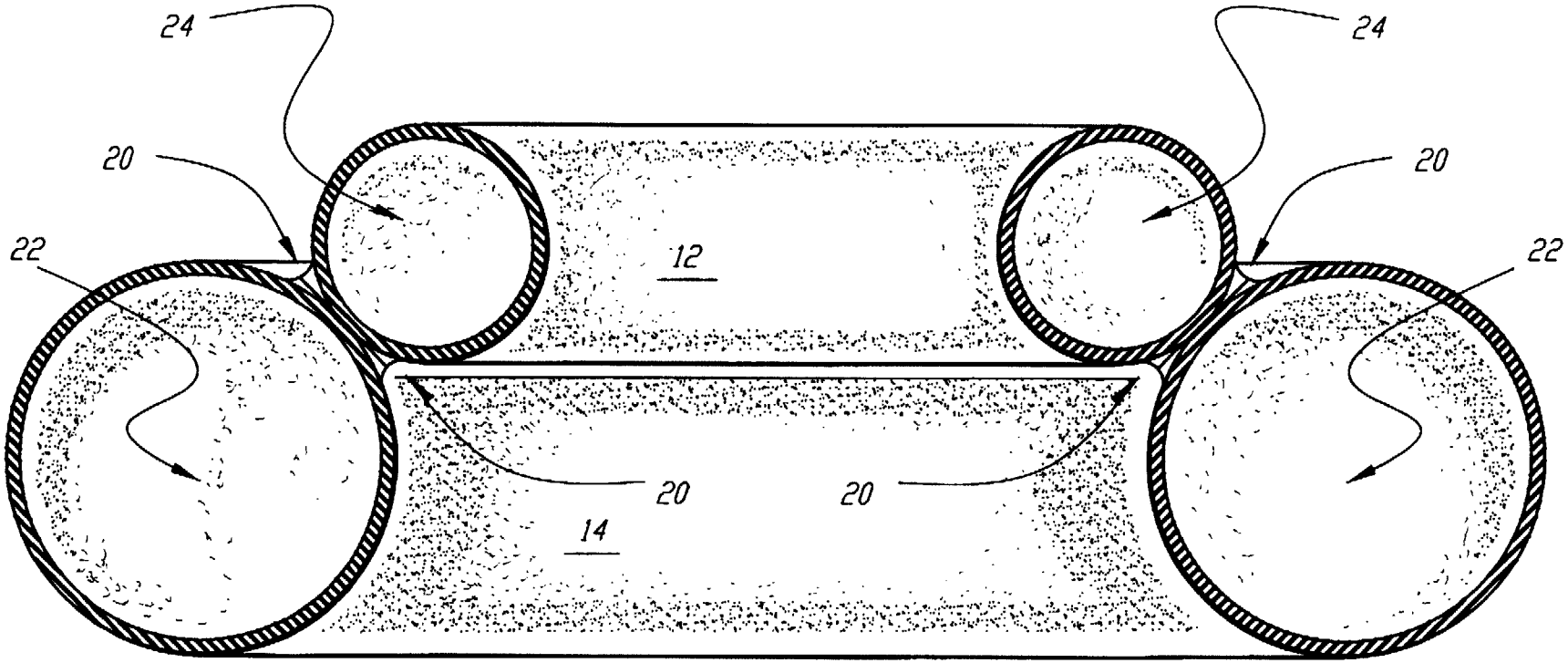
FIG. 3 is a cross section along lines 3—3 of FIG. 2.

FIGS. 1–3 shows the embodiment of the present invention 10 where the inner, smaller tube 12 is positioned upwardly from, but still partially within, the larger tube 14. As seen in FIGS. 1 and 3, when the inner and outer tubes 12, 14 have such an offset arrangement, the region of attachment 20 is proximate the top edge of the outer tube 14.

Figure 4:
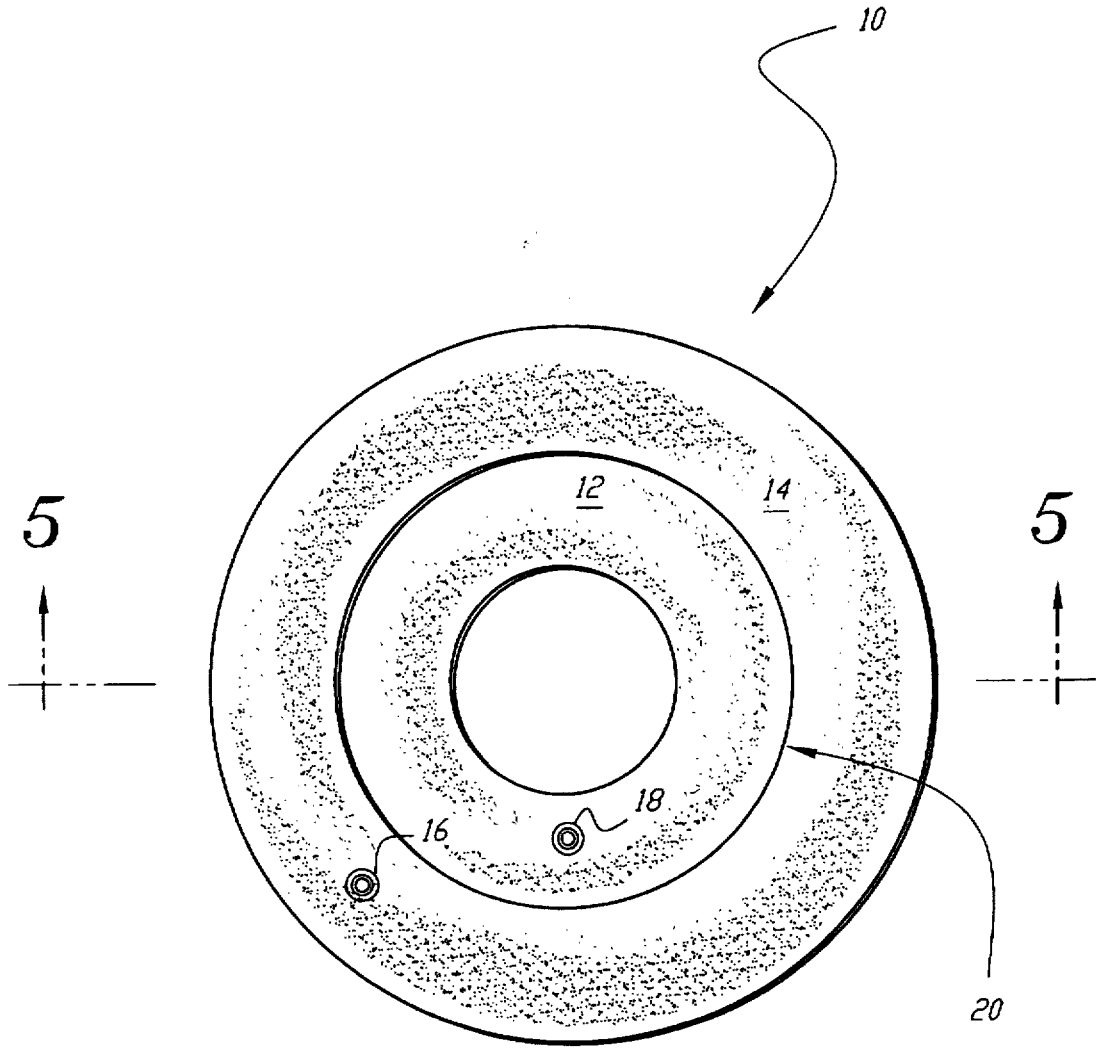
FIG. 4 is top view of another embodiment of the invention.
Figure 5:
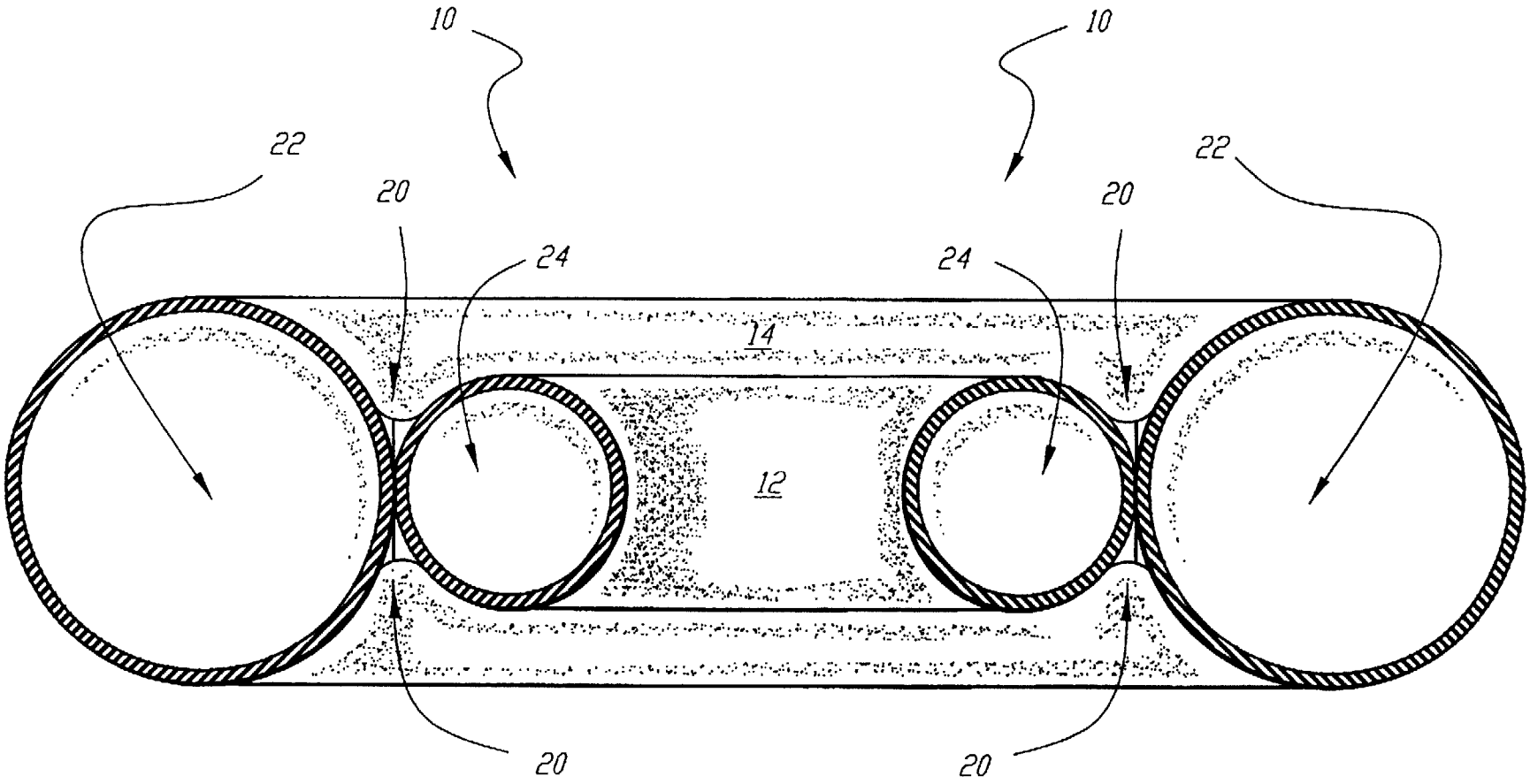
FIG. 5 is a cross section along lines 5—5 of FIG. 4. Similar reference characters denote corresponding features consistently throughout the attached drawings.

FIGS. 4–5 show the other embodiment of the present invention 10 where the inner, smaller tube 12 is positioned entirely within the outer, larger tube 14. As seen in FIG. 5, when the inner and outer tubes 12, 14 have such a concentric arrangement, the region of attachment 20 is between the top edge and bottom edge of the outer tube 14.

In both embodiments, the inner and outer tubes 12, 14 are preferrably rendered bouyant by inflation means. The outer tube 14 has an air valve 16 by which it is inflated and deflated. The inner tube 12 also has an air valve 18 for the same purpose. The air valves 16, 18 are standard, oral inflation devices, or these may be standard Schraeder valves. FIGS. 2 and 4 show the present invention when it is inflated. FIGS. 3 and 5 are a cross section through line 3—3 in FIG. 2 and line 5—5 of FIG. 4, respectively. FIGS. 3 and 5 show the inner tube 12, the outer tube 14, their region of attachment 20, the air space 22 in the outer tube 14, and the air space 24 in the inner tube 12. Preferably, the outer tube 14 is somewhat larger in cross sectional diameter than the inner tube 12, particularly if the inner tube 12 is fitted concentrically within the outer tube 14 as seen in FIGS. 4 and 5.

FIG. 1 shows the present invention 10 being used by a person who is relaxing in a body of water. The outer tube 14 provides buoyancy, while the inner tube 12 supports the user's head, as well as provides additional buoyancy.

The tubes 12, 14 can be made of polyvinylchloride, polyurethane, polyethylene, polypropylene, or other suitably bouyant, flexible material. The tubes 12, 14 may be attached by gluing, ultrasonic welding, or electrostatic welding.

In use, the user will preferably inflate the outer, larger tube 14 before inserting the neck region inside the inner tube 12. At this point, the user will preferably inflate the inner tube 12 to a comfortable pressure. The invention 10 may be used by anyone who simply wants to relax while in water. The user who is recovering from injuries to the neck, back or other areas will find the present invention 10 especially beneficial for relaxation and/or therapeutic purposes.

In particular, after work performed by a chiropractor, the present invention 10 will minimize the movement of the spinal cord proximate the neck; reduce spinal cord pressure; and allow for naturally maintaining the recently performed adjustments. This is due to the relaxed state of the muscles and the muscle memory of these muscles in this relaxed state. Furthermore, the device promotes safety; should the user relaxing in water fall asleep, the invention will hold the user's head above water.

It is to be understood that the present invention is not limited to the embodiments described above, but encompasses any and all embodiments within the scope of the following claims.

I claim:

1. A flotation device comprising:

a buoyant outer tube having a first overall diameter and a first cross sectional diameter, a top edge and an opposing bottom edge; and an inflatable buoyant inner tube having a second overall diameter smaller than said first overall diameter and a second cross sectional diameter smaller than said first cross sectional diameter, said inner tube tangentially and concentrically joined to said outer tube, said inner and outer tubes defining an open interior for receiving a user.

2. The flotation device according to claim 1, wherein said inner tube is concentrically joined to said outer tube proximate said top edge of said outer tube.

3. The flotation device according to claim 1, wherein said inner tube is concentrically joined to said outer tube between said top edge and said bottom edge of said outer tube.

4. The flotation device according to claim 1, said inner tube being inflatable and having an air valve.

5. The flotation device according to claim 1, said outer tube being inflatable and having an air valve.

6. The flotation device according to claim 1, said inner tube and said outer tube being inflatable and each having an air valve.

7. The therapeutic device according to claim 1, wherein the outer tube is made of polyvinylchloride.

8. A method of donning a flotation device in preparation for therapeutically relaxing in water comprising:

providing an inflatable device having a large, outer tube concentrically joined to a small, inner tube;

inflating said large, outer tube;

placing one's head through said small, inner tube until said small, inner tube is around one's neck; and inflating said small, inner tube to snugly engage one's neck for providing support while floating therapeutically in water.

* * * * *